US005271493A

United States Patent [19]

Hall

[11] Patent Number: 5,271,493

[45] Date of Patent: Dec. 21, 1993

[54] TANK VAULT

[76] Inventor: William Y. Hall, 1360 Capitol Dr. #135, San Pedro, Calif. 90732

[21] Appl. No.: 946,026

[22] Filed: Sep. 15, 1992

Related U.S. Application Data

[63] Continuation of Ser. No. 759,703, Sep. 11, 1991, abandoned, which is a continuation of Ser. No. 664,411, Feb. 27, 1991, abandoned, which is a continuation of Ser. No. 452,690, Dec. 19, 1989, abandoned.

[51] Int. Cl.[5] ..... B65D 90/04

[52] U.S. Cl. ..... 220/469; 220/445; 220/453; 220/565

[58] Field of Search ..... 220/1.5, 566, 444, 466, 220/429, 901

[56] References Cited

U.S. PATENT DOCUMENTS

| | | | |
|---|---|---|---|
| 2,128,297 | 8/1938 | Ingersoll | 220/466 X |
| 2,148,278 | 2/1939 | Rose | 220/466 X |
| 2,189,945 | 2/1940 | Fitch | 220/466 X |
| 2,754,992 | 7/1956 | Wilson | 220/444 X |
| 2,892,564 | 6/1959 | Morrison | 220/429 |
| 3,118,559 | 1/1964 | Sticker, Jr. | 220/1.5 X |
| 3,922,987 | 12/1975 | Tornay | 220/901 X |
| 4,374,478 | 2/1983 | Secord | 220/5 A X |
| 4,638,920 | 1/1987 | Goodhues, Jr. | 220/565 X |
| 4,826,644 | 5/1989 | Lindquist et al. | 264/71 |
| 4,890,983 | 1/1990 | Soloman et al. | 417/41 |
| 4,895,272 | 1/1990 | Benedittis et al. | 220/565 X |
| 5,081,761 | 1/1992 | Rinehart et al. | 220/453 X |
| 5,082,138 | 1/1992 | McGarvey | 220/453 X |
| 5,103,996 | 4/1992 | McGarvey | 220/455 X |

*Primary Examiner*—Steven M. Pollard

*Attorney, Agent, or Firm*—Jones, Tullar & Cooper

[57] ABSTRACT

A liquid container for the above-ground storage of flammable fuels is shown having an inner tank with a bottom surface, side surfaces, and a top surface placed within an outer shell having a bottom surface and side surfaces, The bottom surfaces of the inner tank and outer shell are spaced apart from each other by first bottom spacers which connect the two bottom surfaces. The side walls of the inner tank and outer shell are also spaced apart from each other by second side spacers which connect the tank and shell. The bottom and side spacers for connecting the tank and shell prevent the inner tank from floating within the outer shell when an insulating material, such as concrete, is added therebetween.

7 Claims, 3 Drawing Sheets

TANK VAULT

This application is a continuation of application Ser. No. 07/759,703, filed Sep. 11, 1991, now abandoned which is a continuation of Ser. No. 664,411, filed Feb. 27, 1991, now abandoned, which is a continuation of Ser. No. 452,690, filed Dec. 19, 1989, now abandoned.

BACKGROUND OF THE INVENTION

The present invention relates to a vaulted tank and, more particularly, to an above-ground storage tank for flammable liquids.

Since the 1970s, the world and the United States have been concerned with the environment and the contamination of that environment, including the earth's soil, its atmosphere and its water. The first Earth Day in 1970 resulted in the eventual creation of the Environmental Protection Agency by the United States Congress.

One of the many problems which the Environmental Protection Agency has addressed is the deterioration of large, underground storage tanks which result in the leakage of contaminants into the soil, such as the deterioration of gasoline station storage tanks and the leakage of gasoline and diesel fuel into the surrounding water table.

To correct this problem, the EPA has suggested that all fuel storage tanks be placed above ground. This has created a classic confrontation between governmental departments. For example, the fire departments of most major cities prefer that fuel storage tanks be placed below ground to reduce fire hazard. Most municipal codes have been drafted with this concern in mind. In more recent years, the creation of large concrete entombed, above ground tanks has been suggested as a solution to the problem. That is, a gasoline storage tank may be entombed in concrete and placed above the ground to enable its surfaces to be easily checked for deterioration and fluid leakage. By entombing the fuel tank in concrete, the tank is made impervious to impact from a vehicle that might back into it, for example, and resistant to fire due to the insulating effect of the concrete The concrete insulation also provides the minimum two-hour fire resistive protection required by the Uniform Fire Code for above ground tanks. One example of such an entombed tank is shown in U.S. Pat. No. 4,826,644, issued May 2, 1989 to T. R. Lindquist and R. Bambacigno.

The concrete entombed tank has several disadvantages including cost and convenience. For example, a 1,000-gallon concrete entombed tank weighs 18,000 pounds after it has been manufactured. Such a tank requires a large truck and crane with at least two 20-ton nylon straps to transport the tank to the site where it is to be used and to then place the tank in the desired position. The concrete entombed tank is provided with bottom supporting feet to permit the inspection of its bottom surface during its use. In California, where earthquakes represent a real concern, concrete shoes are placed on the site on either side of the bottom supporting feet to prevent the movement of the tank during an earthquake. The placement of the concrete tank between the concrete shoes can be a very dangerous procedure in view of the tank's weight.

SUMMARY OF THE INVENTION

Accordingly, it is an object of the present invention to provide a less expensive, lighter weight and more easily transported tank vault for the above-ground storage of liquid fuels, such as gasoline and diesel fuel.

This object and other objects are accomplished by providing an inner tank having a bottom surface, side surfaces, and a top surface which is placed within an outer shell having a bottom surface and side surfaces. The bottom surface of the inner tank is spaced apart from and connected to the bottom surface of the outer shell by first, bottom spacers which do not extend to the side surfaces of either the inner tank or outer shell. The side surfaces of the inner tank and outer shell are spaced apart and attached to one another by second side spacers which do not extend to the bottom surface of either the inner tank or outer shell. The bottom and side spacers function to prevent the inner tank from floating within the outer shell when an insulating material, such as concrete, is placed therebetween.

The utilization of an inner tank and outer shell with appropriate bottom and side spacers for attaching the two permits the assembled tank to be shipped from the factory to the site where it is intended for use with relative ease because of its light weight. Once properly placed upon the site, the space between the inner tank and outer shell can be filled with a suitable insulation material to meet the strength and insulation requirements of the fire codes of all metropolitan areas. Spacing feet on the bottom surface of the out shell permit all surfaces of the tank vault to be inspected to assure that the tank does not deteriorate and leak. This meets the requirements of the Environmental Protection Agency and the fire departments.

DESCRIPTION OF THE DRAWINGS

A better understanding of the present invention and of additional advantages and objects will be had after consideration of the following specification and drawings, wherein.

DESCRIPTION OF THE PREFERRED EMBODIMENTS

Figure 2:
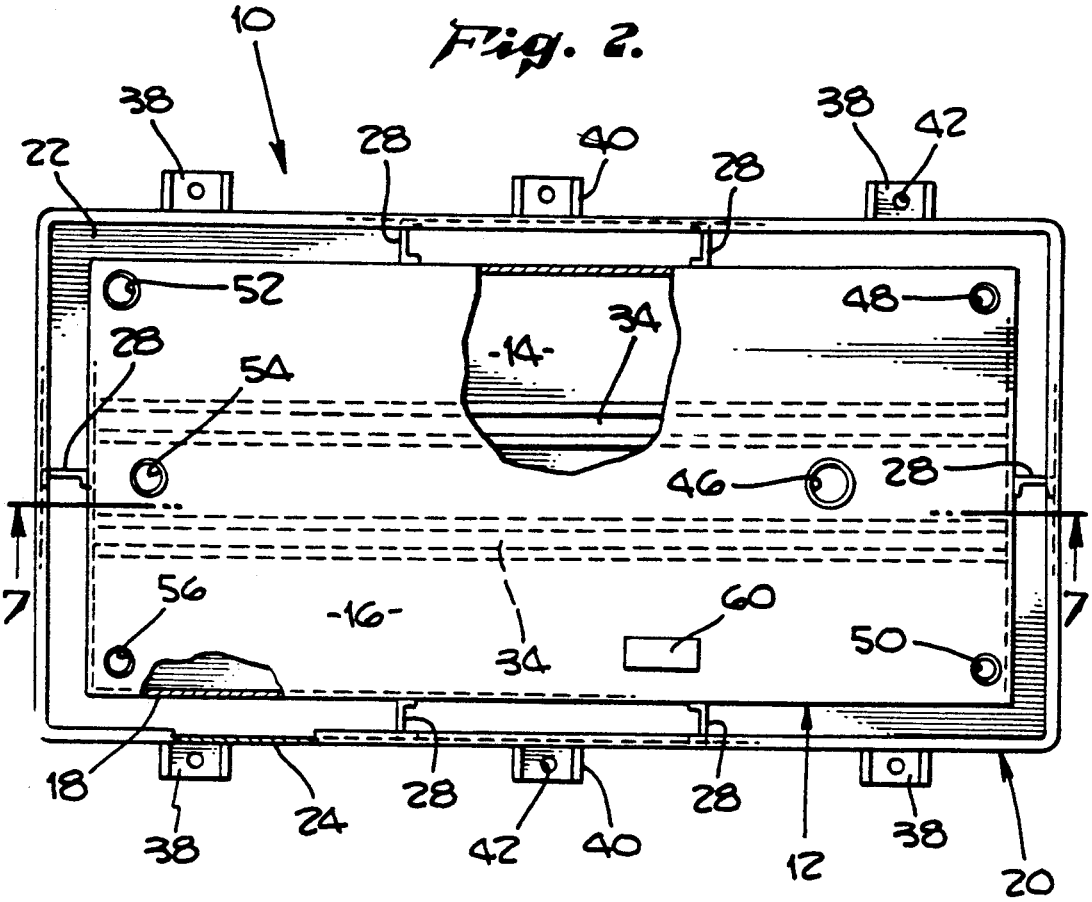
FIG. 2 is a top plan view thereof.

Referring now to the drawings, a tank vault 10 is shown in all figures having an inner tank 12 including a bottom surface 14, top surface 16 and side surfaces 18. The inner tank may be constructed from various types of material including steel, corrosion-resistant steel, aluminum, cast iron, fiberglass, fiberglass-reinforced steel, and polyethylene. In the preferred embodiment, the inner tank is constructed from 3/16-inch thick steel.

The inner tank 12 is spaced apart from an outer shell 20 which also has a bottom surface 22 and side surfaces 24, while the top of the outer shell 20 is open. In the preferred embodiment, the outer shell is made of 10 gauge steel. The inner tank 12 and outer shell 20 are attached in a spaced apart relationship by a first, bottom spacer 26 which, in the preferred embodiment, may be constructed from a C-shaped steel channel that is six inches long and weighs 8.2 pounds per foot (C×6×8.2). This same C-shaped channel may also be used as a second side spacer 28 which attaches and spaces the side surfaces 18 and 24 of the inner tank and outer shell.

Figure 6:
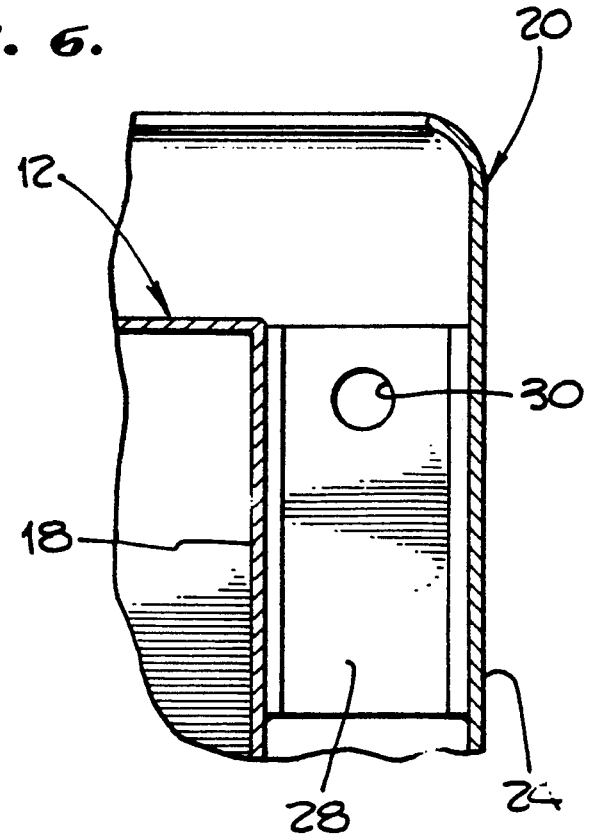
FIG. 6 is a detailed view of the side spacers between the inner tank and outer shell.

The first, bottom spacer 26 may be attached to the bottom surface 14 of inner tank 12 by welding. Similarly, the second side spacers 28 may be attached to the side surfaces or walls 18 of inner tank 12 by welding. The inner tank 12 may then be lowered into the outer shell 20 and the first, bottom spacers 26 attached to the bottom surface 22 of the outer shell 20 by welding plugs which are formed by welding through small holes in the bottom surface 22 directly to the lower surface of the bottom spacers 26 to fill the holes and thus produce the welding plug for the attachment of the spacers 26. Generally, it is not necessary to use welding plugs to attach the second, side spacers 28 to the side surfaces 24 of outer shell 20, as seen in FIG. 6. FIG. 6 shows an aperture 30 in the side spacer 28 which may be used to secure a hook for lifting the assembled tank vault 10 from a truck and placing it at the desired location upon the site where the tank vault 10 is to be used. It will also be seen in FIG. 6 that the upper edges of the side walls 24 of outer shell 20 are each provided with a radius which establishes a smooth rounded upper edge of the tank vault 10 once the insulating material, such as concrete, is poured between the inner tank 12 and outer shell 20. It will also be seen in FIGS. 1, 6 and 7 that the side spacers 28 do not extend to the bottom surfaces 14 or 22 of the inner tank 12 or outer shell 20. Similarly, the bottom spacer 26 does not extend to the side walls 24 of outer shell 20. This permits the insulation material to flow completely between the inner tank 12 and outer shell 20.

The preferred embodiment shows an inner tank 12 in the shape of a rectangular block with the outer shell 20 also shaped as a rectangular block. Other configurations are possible within the teachings of the present invention, including a cubically-shaped inner tank and outer shell or a cylindrically-shaped inner tank mounted within an outer shell in the form of a rectangular block. In this latter arrangement, the bottom surface of the inner tank is the bottom edge of the cylindrical shape while the side walls include the two side edges of the cylinder and the two flat ends thereof.

It has been found that the second, side supports 28 are very important in the fabrication of the inner tank 12 and outer shell 20 in that the pouring of the insulating material, such as concrete, can cause the inner tank 12 to float within the outer shell 20. This problem has not occurred in the prior art as the prior art generally does not contemplate such large volume when fabricating the inner and outer tanks. To prevent the flotation of the inner tank 12 within the outer shell 20, the bottom spacers 26 and/or side spacers 28 securely attach the tank 12 within the shell 20. Further, the prior art does not contemplate the problems that would be experienced when an insulating material, such as concrete, is poured to fill the space between the inner tank 12 and the outer shell 20. Such problems include the possible bowing of either the inner side walls 14 or the outer side walls 20 of tank 12 and shell 20 and the collapse of the top surface 16 of tank 12. To eliminate this problem, inner supports are utilized, including inner side supports 32, shown in FIGS. 1, 3, 4, 5 and 7, and inner top supports 34, shown in FIGS. 1, 2 and 4. In the preferred embodiment, the inner side supports 32 are made of 10 gauge steel sheets with a hat-shaped cross-section having a three inch crown, one inch sidewalls and a one inch brim on the outer edge of each side wall. In the preferred embodiment, the inner top supports 34 are formed from the same material and in the same shape.

Figure 7:
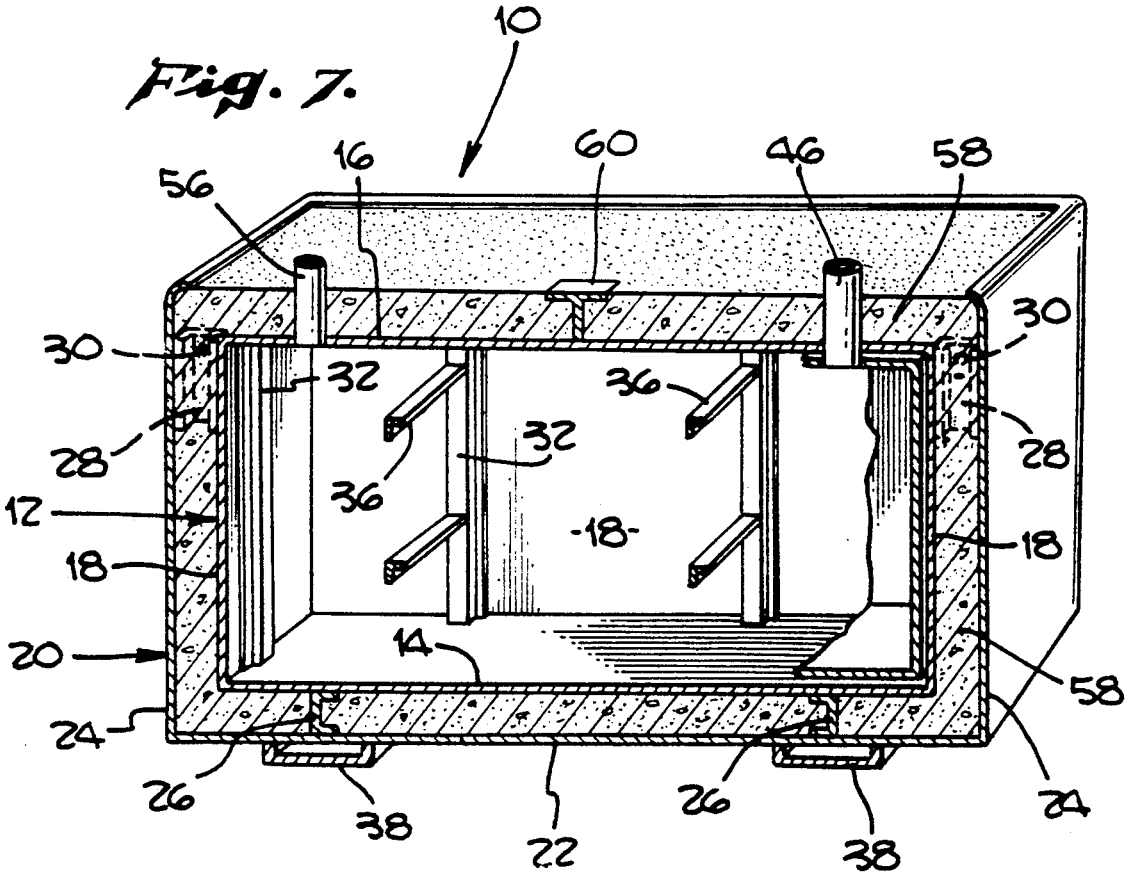
FIG. 7 is a cross-sectional view taken along line 7—7 of FIG. 2 shown in perspective after insulating material, such as concrete, has been poured between the inner tank and outer shell of the tank vault.

Further support is provided to the side surfaces 18 of inner tank 12 by cross-rib supports 36 seen in FIGS. 3, 4, 5 and 7. It will be seen in FIGS. 3 and 4 that the preferred embodiment may include three pairs of cross-rib supports which attach opposite side walls 18 of the inner tank 12 at the inner side supports 32. As seen in FIG. 7, the cross-rib supports 36 are formed from a 2×2×¼-inch angle channel which is attached to the inner supports 32, as by welding. Similarly, the inner side supports 32 and top supports 34 are attached to the side surfaces 18 and top surface 16 of the inner tank 12 by welding.

Figure 3:
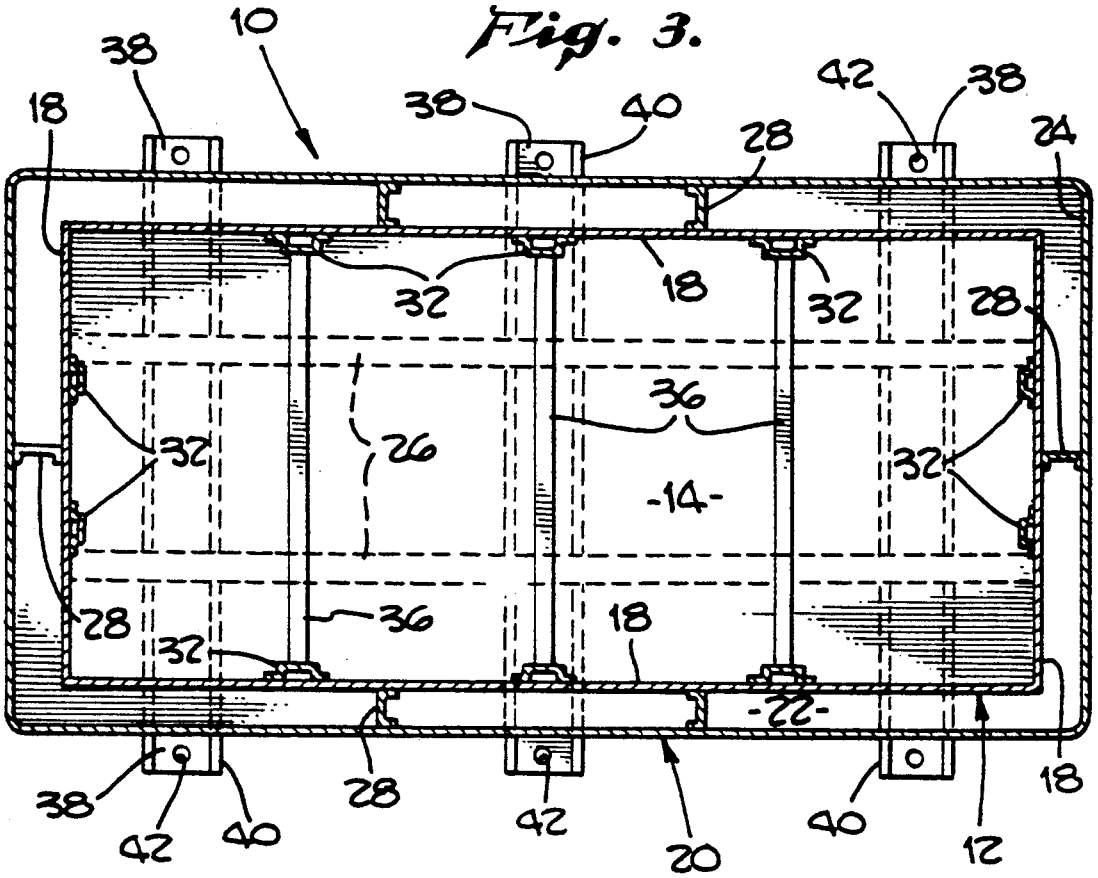
FIG. 3 is a cross-sectional view taken along line 3—3 of FIG. 1.
Figure 4:
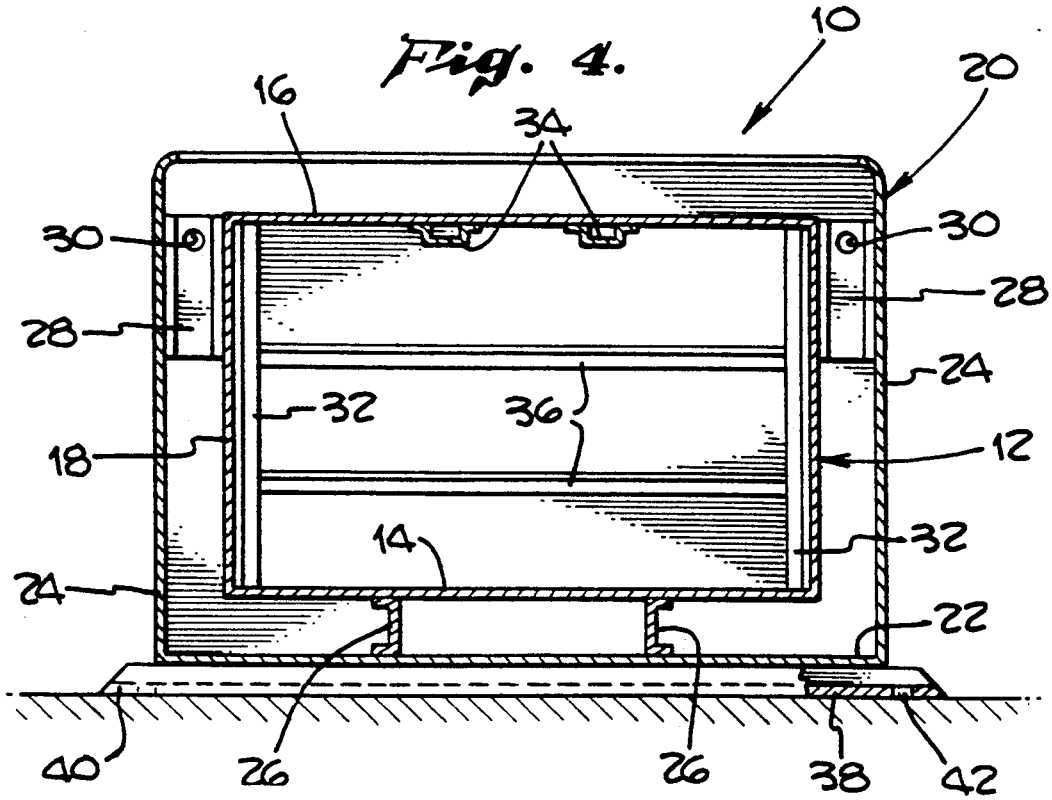
FIG. 4 is a cross-sectional view taken along line 4—4 of FIG. 1.
Figure 5:
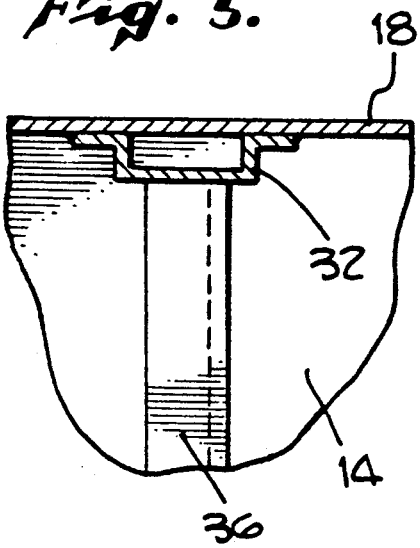
FIG. 5 is a detailed view showing the inner support ribs of the inner tank.

To complete the prefabricated assembly of the tank vault 10, a third set of spacers or mounting feet 38, seen in FIGS. 1, 2, 3, 4 and 7, are attached to the bottom surface 22 of outer shell 20, as by welding. These mounting feet 38 may be formed from the same C-shaped channel that forms the bottom and side spacers 26 and 28. As best seen in FIGS. 2, 3 and 4, the mounting feet 38 extend beyond the width of the outer shell 20 to form extensions 40 into which apertures 42 have been placed, as seen in FIG. 3. These apertures receive suitable lag bolts or other fasteners which may be driven into a concrete mounting pad or other suitable mounting surface upon which the tank vault 10 is ultimately placed. The extensions 40 thus provide a convenient way for securing the tank vault 10 to the surface, of its mounting site to prevent the tank 10 from moving during an earthquake.

Figure 1:
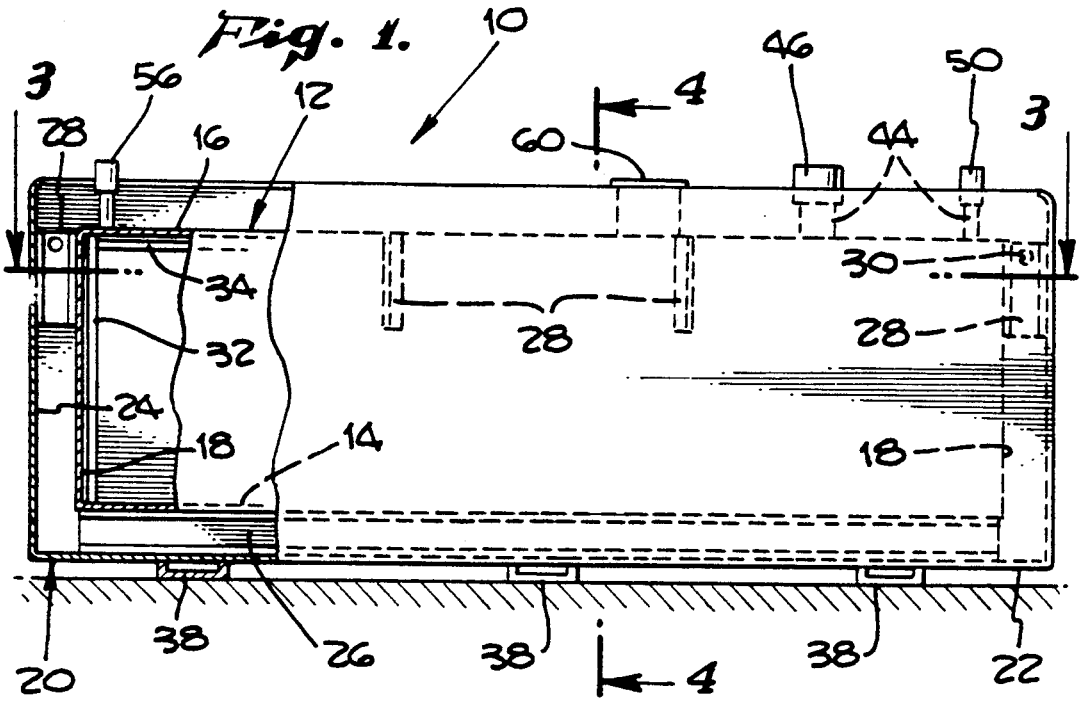
FIG. 1 is a side elevational view of the tank vault of the present invention.

As best seen in FIGS. 1 and 2, the top surface 16 of inner tank 12 is provided with several apertures into which various sized pipe fittings 44 may be attached, as by welding. The purpose of these pipe fittings 44 are many and varied. In the preferred embodiment shown in FIG. 2, they include the following: a six-inch tank bung 46 located in the center of the right-hand portion of the top surface 16 for mounting a 2.5-pound emergency vent; a two-inch tank bung 48 located in the upper, right-hand corner of the top surface 16 for a vent; a two-inch tank bung 50 located in the lower, right-hand surface of tank cover 16 to mount a sight level gauge; a four-inch tank bung 52 in the upper, left-hand corner of top surface 16 for a phase one vapor recovery device; a four-inch tank bung 54 in the center, left-hand section of the top surface 16 for filling the tank 10; and a two-inch tank bung 56 in the lower, left-hand corner of surface 16 for a gas pump.

The tank vault 10 shown in FIGS. 1–7 weighs approximately 2,400 pounds in the prefabricated state as shown in FIGS. 1–6 and holds 1,000 gallons. The reader will understand that several variations of the tank structure are possible and that the specific shape and sizes of the inner and outer tanks, the bottom spacers 26, side spacers 28, mounting feet 38, side supports 32, top supports 34, and cross-rib supports 36 may all vary within the teachings of the present invention. Further, the inner tanks 12 may be fabricated with a double sided top, sides and bottom as shown in FIG. 7. The size of the tank vault 10 may also vary to accommodate many volumes, such as 250, 500, 1,000 and 2,000 gallons.

In the present invention, it is anticipated that the 250 gallon tank vault 10 will have an inner tank 12 with a length of 80 inches, a height of 25 inches, and a width of 30 inches. The dimensions of the outer shell 20 will include a length of 92 inches, a height of 37 inches, and a width of 42 inches. This 250 gallon tank will have a single side spacer 28 that is 12 inches long and two sets of vertical inner side supports 32 with a single cross-rib support 36 between each. The 500 gallon tank 10 has an inner tank dimension of 120 inches long by 26 inches high by 37 inches wide, and an outer shell dimension of 132 inches long by 38 inches high by 49 inches wide. Along the length of the side walls 18 and 24 of the inner tank 12 and outer shell 20 are two side spacers 28, while the inner side supports 32 number three along the long side wall with single cross-rib supports 36 therebetween. The 1,000 gallon tank has an inner tank dimension of 120 inches long by 46 inches high by 42 inches wide with the outer shell dimensions being 132 inches by 58 inches by 54 inches. The inner supports are the same as for the 500 gallon tank except that there are two cross-rib supports 36 between each of the inner side supports 32 rather than one. A 2,000 gallon tank includes an inner tank 12 with a length of 120 inches, a height of 55 inches, and a width of 70 inches; while the outer shell measures 132 inches long by 67 inches high by 82 inches wide. The side supports 28 are twice as long as the side supports within the 1,000 gallon tank, while the inner side supports 32 and cross-rib supports are the same in number as for the 1,000 gallon tank. Each tank has the same number of bottom spacers 26 for providing a standoff between the inner tank and outer shell. The 250 gallon tank has two mounting feet 38, while the remaining tanks have three.

After the tank vault 10 has been properly placed at the desired site, the space between inner tank 12 and outer shell 20 may be filled with a suitable insulating material 58, shown in FIG. 7. In the preferred embodiment, this insulating material is concrete. However, other materials may be used including cement, sand, gravel, a heat-resistant plastic such as polyethylene, or a fire-retardant foam. In general, the material should be fire-resistant and meet or exceed a two-hour firewall rating. In some situations, such as when the tank is intended to be used to store waste oil, for example, it may not be necessary to fill the space between the inner and outer tanks with any insulating material 48. As the insulating material 58 is poured into the space between the inner tank 12 and outer shell 20, the tanks are vibrated by a suitable vibrating tool to ensure that all spaces between the tank and shell are filled. The outer shell is then filled to a level equal to the upper edge of its side walls 24 so that the rounded edges thereof are flush with the upper surface of the insulating material. A T-shaped standoff 60 may be attached to the top surface 16 of inner tank 12, as by welding. It will be seen that the standoff 60 is flush with the upper surface of the insulating material 58. This standoff 60 thus provides a mounting platform upon which to place a nameplate or other information. Once filled with concrete 58, for example, a gasoline pump, not shown, may be mounted to the side surface 24 of the outer shell 20 and connected to the two-inch tank bung 56.

As discussed above, many shapes of the inner tank 12 and outer shell 20 are possible. The inner tank 12 may be constructed from several different materials and the space between it and the outer shell 20 may be varied and filled with several different insulating materials within the teaching of this invention. Further, the shape, number, configuration and material of the bottom spacers 26, side spacers 28, inner side supports 32, inner top supports 34, cross-rib supports 36, and mounting feet 38 may vary within the teachings of this invention. It will also be noted that the placement of the inner side supports 32 within the inner tank 12 is usually such that they do not align themselves with the side supports 28 thereby increasing the rigidity of the side walls 18. In view of the number of variations possible within the tank vault of the present invention, that invention should be limited only by the appended claims.

I claim:

1. A container for the storage of hazardous liquids comprising:

an inner, liquid tight, substantially closed vessel having top, bottom and side walls impervious to hazardous liquids to be stored and defining an outer surface and including at least one fluid conduit communicating with the interior of said inner vessel for receiving a hazardous liquid for storage in said inner vessel;

support means for said top and side walls to reinforce said walls to support insulating material;

an outer, liquid tight free standing container vessel separate from said inner vessel and having bottom and side walls defining an inner surface and an outer periphery impervious to hazardous liquids stored in said inner vessel, said inner vessel being disposed within and supported by said outer vessel to define a substantially continuous space between said side and bottom walls of said inner vessel and said side and bottom walls of said outer vessel, said outer vessel side walls having inwardly curved upper edges to form an open top with a rounded edge, said open top providing access to said outer vessel for placement of said inner vessel therein and providing an aperture for access to the space between said inner vessel and said outer vessel;

at least one bottom spacer member secured between said bottom walls of said inner and outer vessels;

a plurality of side spacer members secured between said side walls of said inner and outer vessels and extending therebetween along only a portion of said side walls for spacing said inner vessel away from the inner surface of said containment vessel by a predetermined distance to provide said substantially continuous space, each of said bottom and side spacer members being initially fastened to a corresponding wall of only one of said inner and outer vessels to enable said inner vessel to be placed into said separate outer vessel to assemble said container at a predetermined location, said bottom and side spacer means, upon assembly of said container, extending across said space to engage a corresponding wall of the other of said inner and outer vessels;

fastening means on at least one of said walls of said other of said inner and outer vessels to engage one of said spacer members to thereby secure said inner vessel to said outer containment vessel to prevent flotation of said inner vessel within said outer vessel and to maintain substantially constant spacing between corresponding walls of said inner and outer vessels when insulating material in a fluid state is introduced into the space between said inner vessel and said outer vessel;

a pourable insulating material, introduced through said aperture in a fluid state, disposed within said outer vessel and substantially uniformly and completely surrounding said inner vessel with a predetermined thickness of said insulating material, said fluid insulating material flowing around said spacer members to fill said space between said inner vessel and said outer vessel, said fluid conduit means extending beyond said insulating material and the outer periphery of said containment vessel; and wherein said container is adapted to be mounted to a mounting surface and said outer container vessel bottom wall has an outer surface, said container further comprising a plurality of foot members secured to said outer surface of said outer vessel bottom wall, each of said foot members including a distal portion extending beyond said side wall of said outer containment vessel, and each said distal portion of said foot members including an aperture formed therein for attaching said container to said mounting surface.

2. The container of claim 1, wherein said fluid conduit means extends through said insulating material.

3. The container of claim 1, wherein said support means for said top and side walls includes a plurality of ribs mounted to said top and side walls of said inner vessel.

4. The container of claim 3, wherein said plurality of ribs are hat-shaped, said support means further including a plurality of cross-ribs mounted between said hat-shaped ribs to connect said hat-shaped ribs.

5. The container of claim 3, wherein said support means for said side and top walls are not aligned with said side spacer members.

6. The container of claim 1, wherein said inner, substantially closed vessel includes a second bottom wall, a second top wall, and a second side wall.

7. The container of claim 1, wherein said side spacer members include apertures formed therein.

* * * * *

UNITED STATES PATENT AND TRADEMARK OFFICE

CERTIFICATE OF CORRECTION

PATENT NO. : 5,271,493

DATED : December 21, 1993

INVENTOR(S) : William Y. Hall and William A. Hall

It is certified that error appears in the above-identified patent and that said Letters Patent is hereby corrected as shown below: On the title page:

In the heading, please change the inventor to read as follows:

—William Y. Hall, 1360 Capitol Dr. #135, San Pedro, Calif. 90732, and

William A. Hall, 2104 Paseo Del Mar, Palos Verdes Estates, Calif. 90274.—

Signed and Sealed this

Tenth Day of May, 1994

*Attest:*

Bruce Lehman

BRUCE LEHMAN

*Attesting Officer*

*Commissioner of Patents and Trademarks*